US009204719B2

(12) United States Patent
Hu

(10) Patent No.: US 9,204,719 B2
(45) Date of Patent: Dec. 8, 2015

(54) DOCUMENT ORGANIZER

(71) Applicant: Wei-Cheng Hu, Taoyuan County (TW)

(72) Inventor: Wei-Cheng Hu, Taoyuan County (TW)

( * ) Notice: Subject to any disclaimer, the term of this patent is extended or adjusted under 35 U.S.C. 154(b) by 125 days.

(21) Appl. No.: 14/013,199

(22) Filed: Aug. 29, 2013

(65) Prior Publication Data

US 2015/0060377 A1 Mar. 5, 2015

(51) Int. Cl.

| | |
|---|---|
| ***A47F 3/14*** | (2006.01) |
| ***A47F 7/14*** | (2006.01) |
| ***B42F 17/00*** | (2006.01) |
| ***A47B 63/00*** | (2006.01) |
| ***A47F 5/11*** | (2006.01) |
| ***A47B 63/06*** | (2006.01) |
| ***B42F 7/10*** | (2006.01) |
| ***A47F 7/00*** | (2006.01) |
| ***A47B 45/00*** | (2006.01) |

(52) U.S. Cl.

CPC ..... *A47B 63/00* (2013.01); *A47B 45/00* (2013.01); *A47B 63/06* (2013.01); *A47F 5/114* (2013.01); *A47F 7/0035* (2013.01); *B42F 7/10* (2013.01)

(58) Field of Classification Search

CPC .... A47B 63/00; A47B 87/02; A47B 87/0207; A47B 87/0261; A47B 87/0269; A47B 47/06; A47B 63/06; A47B 47/024; A47B 47/021; B42F 7/12; B42F 7/10; B42F 17/08; B42F 7/00; B42F 17/18; A47F 5/112; A47F 5/116; A47F 5/10; A47F 5/114; A47F 7/0028; A47F 5/0025; A47F 5/0043; A47F 7/0035; A47F 7/0042; A47F 7/145; A47F 7/146

USPC ..... 211/126.2, 72, 73, 126.16, 126.13, 211/132.1, 50, 10, 11, 195, 153, 149, 59.4; 206/507, 4.28, 509, 532, 533, 554

See application file for complete search history.

(56) References Cited

U.S. PATENT DOCUMENTS

| | | | | | |
|---|---|---|---|---|---|
| 2,713,531 | A * | 7/1955 | Boone | 312/183 |
| 4,154,159 | A * | 5/1979 | Ortega | 100/34 |
| 4,463,684 | A * | 8/1984 | Klungle et al. | 108/91 |
| 4,469,231 | A * | 9/1984 | Hehn | 211/11 |
| 4,552,271 | A * | 11/1985 | Kranz | 211/126.16 |
| 4,669,651 | A * | 6/1987 | Shaw et al. | 229/67.3 |
| 4,768,655 | A * | 9/1988 | MacGregor | 211/11 |
| 4,779,752 | A * | 10/1988 | Vallee et al. | 220/533 |
| 4,782,972 | A * | 11/1988 | Wenkman et al. | 220/4.28 |
| 4,889,244 | A * | 12/1989 | Hehn et al. | 211/40 |
| 5,630,658 | A * | 5/1997 | Jeter | 312/107 |
| 5,634,555 | A * | 6/1997 | Dunham | 206/19 |
| 5,642,923 | A * | 7/1997 | Meacham et al. | 312/258 |
| 5,868,066 | A * | 2/1999 | Maher | 100/34 |
| 6,042,204 | A * | 3/2000 | Quirch et al. | 312/273 |
| 6,435,355 | B1 * | 8/2002 | Brown | 211/44 |
| 6,585,117 | B2 * | 7/2003 | LaFontaine et al. | 211/10 |
| 2015/0060377 | A1 * | 3/2015 | Hu | 211/50 |

* cited by examiner

*Primary Examiner* — Jennifer E Novosad

(74) *Attorney, Agent, or Firm* — Rosenberg, Klein & Lee

(57) ABSTRACT

A document organizer includes a base frame, a rear frame, a front frame, and a plurality of dividers. The base frame includes a plurality of base boards and base connecting boards. Each base board has a first folding line. The rear frame includes a plurality of rear boards and rear connecting boards. Each rear board has a third folding line. The front frame includes a plurality of front boards and front connecting boards. Each front board has a fifth folding line. Each divider has a fourth coupling portion, a fifth coupling portion, and a sixth coupling portion correspondingly couple to a first coupling portion, a second coupling portion, and a third coupling portion. The base frame, read frame, front frame, and the dividers cooperatively define a plurality of storage space therebetween. As a result, the document organizer is collapsible to save space and materials.

4 Claims, 7 Drawing Sheets

DOCUMENT ORGANIZER

BACKGROUND OF THE INVENTION

1. Field of the Invention

The instant disclosure relates to a document organizer; in particular, to a modular document organizer.

2. Description of Related Art

Document organizers are typically known and used for storing documents in an organized fashion. A conventional document organizer is typically made of plastic materials via injection molding into an integrally formed organizer through which documents can be stored therein. However, the integrally formed organizer tends to be bulky which takes up relatively large amount of space and causes inconvenience in packaging and transportation. Although modular organizers are already in the market, yet the conventional organizers are not collapsible, still take up a relatively large amount of space, and do not save in materials.

To address the above issues, the inventor strives via associated experience and research to present the instant disclosure, which can effectively improve the limitation described above.

SUMMARY OF THE INVENTION

The object of the instant disclosure is to provide a modular document organizer which is collapsible after assembly to save space, materials, and cost.

In order to achieve the aforementioned objects, according to an embodiment of the instant disclosure, a document organizer is provided which includes a base frame including a plurality of base boards and a plurality of base connecting boards, a rear frame including a plurality of rear boards and a plurality of rear connecting boards, a front frame including a plurality of front boards and a plurality of front connecting boards, and a plurality of dividers.

Each base board has a first folding line arranged on a center portion thereof, each base board has two sides, each side is connected to the base connecting board through a second folding line, and each base connecting board has a first coupling portion arranged thereon.

Each rear board has a third folding line arranged on a center portion thereof, each rear board has two sides, each side is connected to the rear connecting board through a fourth folding line, and each rear connecting board has a second coupling portion arranged thereon.

Each front board has a fifth folding line arranged on a center portion thereof, each front board has two sides, each side is connected to the front connecting board through a sixth folding line, and each front connecting board has a third coupling portion arranged thereon.

Each divider has a fourth coupling portion arranged on a base portion of each divider, a fifth coupling portion arranged on a rear portion of each divider, and a sixth coupling portion arranged on a front portion of reach divider. The fourth coupling portions of the dividers coupled to the first coupling portions of the base frame, the fifth coupling portions of the dividers coupled to the second coupling portions of the rear frame, the sixth coupling portions of the dividers coupled to the third coupling portions of the front frame, and the base frame, read frame, front frame, and the dividers cooperatively defined a plurality of storage space.

The instant disclosure has the following improvements. The base frame, rear frame, and front frame of the document organizer respectively have folding lines arranged thereon such that when the document organizer is assembled, the document organizer is collapsible to save space. A divider can provide two adjacent storage spaces and savings in materials.

In order to further understand the instant disclosure, the following embodiments and illustrations are provided. However, the detailed description and drawings are merely illustrative of the disclosure, rather than limiting the scope being defined by the appended claims and equivalents thereof.

DETAILED DESCRIPTION OF THE PREFERRED EMBODIMENTS

Figure 1:
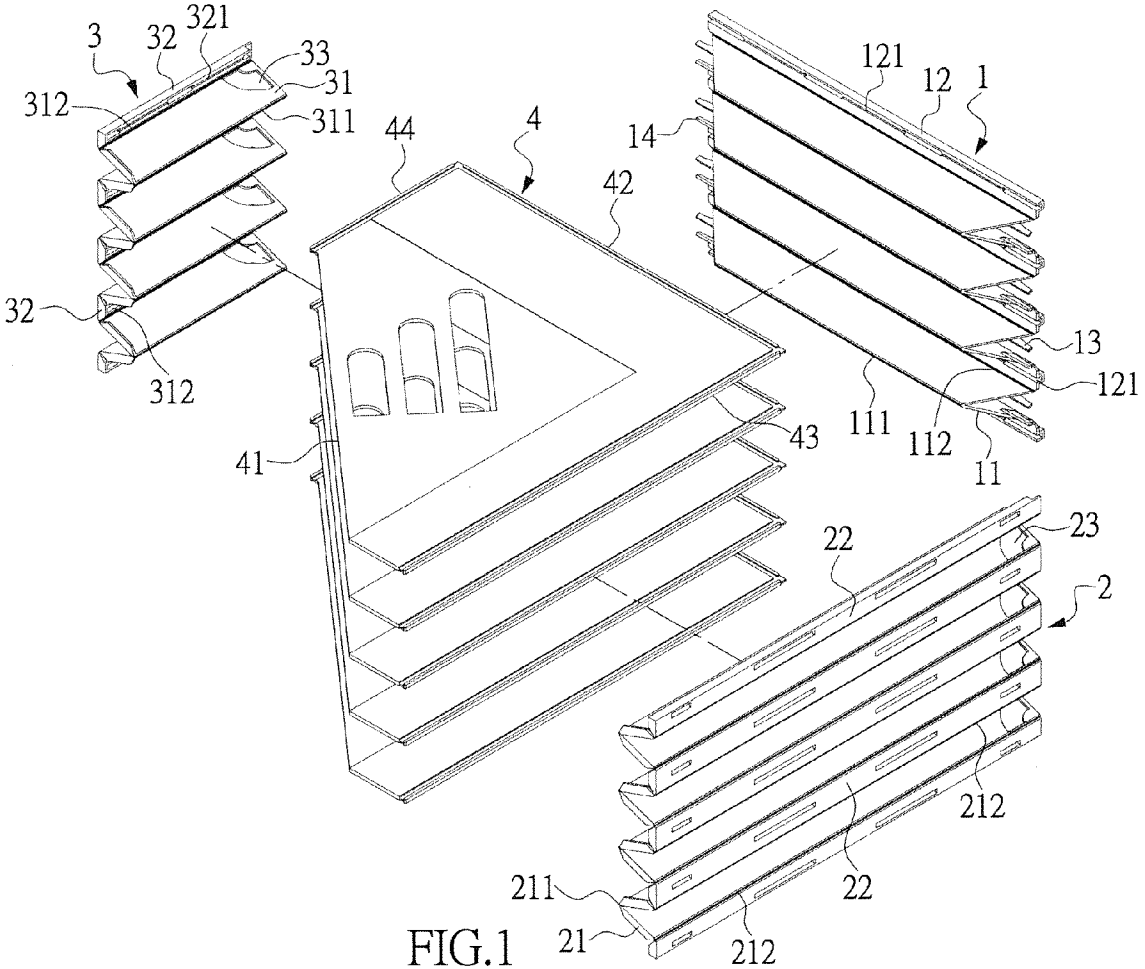
FIG. 1 is an exploded view of a document organizer in accordance with the instant disclosure.
Figure 2:
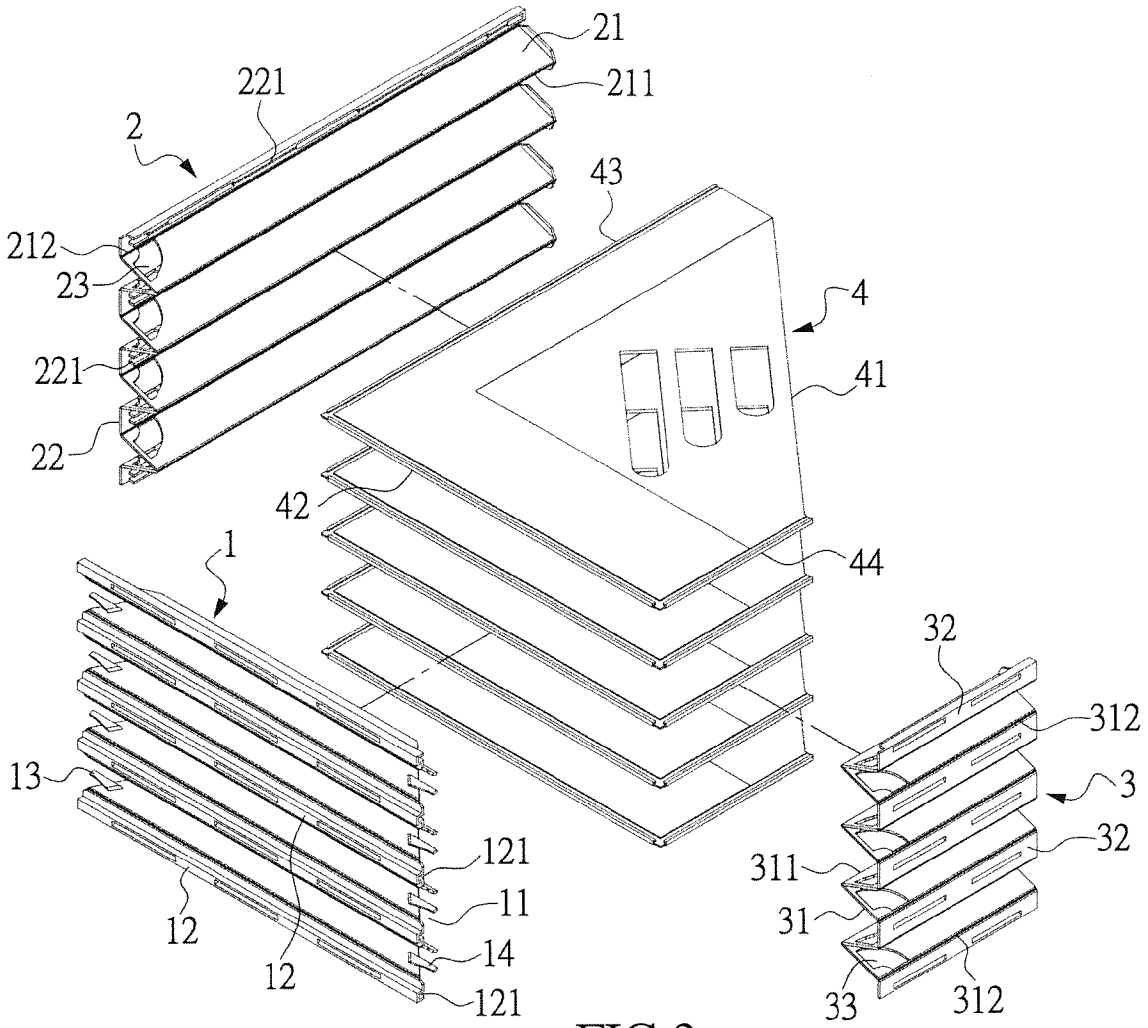
FIG. 2 is another exploded view of the document organizer in accordance with the instant disclosure.

Please refer to FIGS. 1 to 5. The instant disclosure provides a document organizer which includes a base frame 1, a rear frame 2, a front frame 3, and a plurality of dividers 4. The base frame 1, rear frame 2, front frame 3, and dividers 4 can be made of plastic materials, but are not limited herein.

The base frame 1 includes a plurality of base boards 11, and a plurality of base connecting boards 12. The base boards 11 are rectangular shaped boards. The quantity of base board 11 is not limited to three, four, five, or six boards and is adjusted depending on needs. In the instant embodiment, there are four base boards 11. Each base board 11 has a first folding line 111 arranged on a center portion thereof. The first folding line 111 longitudinally extends along the base board 11, namely extending from the front end to the rear end of the base board 11, such that the base board 11 can be folded (bend) or expanded via the first folding line 111. The base connecting boards 12 and the base boards 11 cooperatively form a waveform configuration. Two sides of each of the base boards 11 respectively connect the base connecting boards 12 via a second folding line 112. Namely, the base boards 11 and the base connecting boards 12 are connected via the second folding line 112 such that the base boards 11 and the base connecting boards 12 can be bent therebetween. The first folding line 111 and the second folding line 112 are flexible connection portions connected between the two boards such that the two boards can be bent at various angles therebetween.

A rear end of each base board 11 has two rear fixing tabs 13 disposed thereon. The two rear fixing tabs 13 are arranged on two sides of the rear end of the base board 11. A front end of each base board 11 has two front fixing tabs 14 disposed thereon. The two front fixing tabs 14 are arranged on two sides of the front end of the base board 11. The rear fixing tabs 13 and the front fixing tabs 14 can be used to respectively clamp the rear frame 2 and the front frame 3. Each base connecting board 12 has a first coupling portion 121 arranged thereon, the first coupling portion 121 can be a coupling female portion (i.e. a grooves, a slot) or a coupling male portion (i.e. a tab). In the instant embodiment, the first coupling portion 121 is a groove recessed on an inner surface of the base connecting board 12 to couple to a base portion of the divider 4.

The rear frame 2 includes a plurality of rear boards 21, and a plurality of rear connecting boards 22. The rear boards 21 are rectangular shaped boards. The quantity of rear board 21 is not limited to three, four, five, or six boards and is adjusted depending on needs. In the instant embodiment, there are four rear boards 21. Each rear board 21 has a third folding line 211 arranged on a center portion thereof. The third folding line 211 longitudinally extends along the rear board 21, namely extending from the front end to the rear end of the rear board 21, such that the rear board 21 can be folded (bend) or expanded via the third folding line 211. The rear connecting boards 22 and the rear boards 21 cooperatively form a wave-form configuration. Two sides of each of the rear boards 21 respectively connect the rear connecting boards 22 via a fourth folding line 212. Namely, the rear boards 21 and the rear connecting boards 22 are connected via the fourth folding line 212 such that the rear boards 21 and the rear connecting boards 22 can be bent therebetween. The third folding line 211 and the fourth folding line 212 are flexible connection portions connected between the two boards such that the two boards can be bent at various angles therebetween.

A base end of each rear board 21 has two rear fixing openings 23 disposed thereon. The two rear fixing openings 23 are arranged on two sides of the base end of the rear board 21. The rear fixing openings 23 are curved shaped and can be used to engage a rear end of the base frame 1. Each rear connecting board 22 has a second coupling portion 221 arranged thereon, the second coupling portion 221 can be a coupling female portion (i.e. a groove, a slot) or a coupling male portion (i.e. a tab). In the instant embodiment, the second coupling portion 221 is a groove recessed on an inner surface of the rear connecting board 22 to couple to a rear portion of the divider 4.

The front frame 3 includes a plurality of front boards 31, and a plurality of front connecting boards 32. The front boards 31 are rectangular shaped boards. The front board 31 has a length shorter than a length of the rear board 21. The quantity of front board 31 is not limited to three, four, five, or six boards and is adjusted depending on needs. In the instant embodiment, there are four front boards 31. Each front board 31 has a fifth folding line 311 arranged on a center portion thereof. The fifth folding line 311 longitudinally extends along the front board 31, namely extending from the front end to the rear end of the front board 31, such that the front board 31 can be folded (bend) or expanded via the fifth folding line 311. The front connecting boards 32 and the front boards 31 cooperatively form a wave-form configuration. Two sides of each of the front boards 31 respectively connect the front connecting boards 32 via a sixth folding line 312. Namely, the front boards 31 and the front connecting boards 32 are connected via the sixth folding line 312 such that the front boards 31 and the front connecting boards 32 can be bent therebetween. The fifth folding line 311 and the sixth folding line 312 are flexible connection portions connected between the two boards such that the two boards can be bent at various angles therebetween.

A base end of each front board 31 has two front fixing openings 33 disposed thereon. The two front fixing openings 33 are arranged on two sides of the base end of the front board 31. The front fixing openings 33 are curved shaped and can be used to engage a front end of the base frame 1. Each front connecting board 32 has a third coupling portion 321 arranged thereon, the third coupling portion 321 can be a coupling female portion (i.e. a groove, a slot) or a coupling male portion (i.e. a tab). In the instant embodiment, the third coupling portion 321 is a groove recessed on an inner surface of the front connecting board 32 to couple to a front portion of the divider 4.

The quantity of the dividers 4 is not limited to four, five, six or seven, and is adjusted depending on needs. In the instant embodiment, there are five dividers 4. The divider 4 can be a board with a corner cut 41 such that a front end and a rear end of the divider 4 have various lengths. A base end of each divider 4 has a fourth coupling portion 42 arranged thereon, the rear end of each divider 4 has a fifth coupling portion 43 arranged thereon, and the front end of each divider 4 has a sixth coupling portion 44 arranged thereon. The fourth, fifth, and sixth coupling portions 42, 43, 44 can be coupling female portions (i.e. grooves, slots) or coupling male portions (i.e. tabs, strips). In the instant embodiment, the fourth, fifth, and sixth coupling portions 42, 43, 44 are coupling male portions corresponding to the first, second, and third coupling portions 121, 221, 321 and respectively coupled to the base, rear, and front frames 1, 2, 3.

The engaging structure of the first, second, third, fourth, fifth, and sixth coupling portions 121, 221, 321, 42, 43, 44 are not limited to the examples provided herein as long as the corresponding coupling portions are engaged to each other. Other examples of coupling structures such as coupling female portions (i.e. grooves, slots, pin holes) and the corresponding coupling male portions (i.e. tabs, hooks, bolts) or other coupling structures providing similar engagement or coupling between two coupling portions. In the instant embodiment, the fourth, fifth, and sixth coupling portions 42, 43, 44 are coupling structures with a T-shaped cross-sectional area, whereas the first, second, and third coupling portions 121, 221, 321 are coupling structures having grooves which correspond to the T-shaped cross-sectional area such that the fourth, fifth, and sixth coupling portions 42, 43, 44 can respectively wedged in the first, second, and third coupling portions 121, 221, 321.

Figure 3:
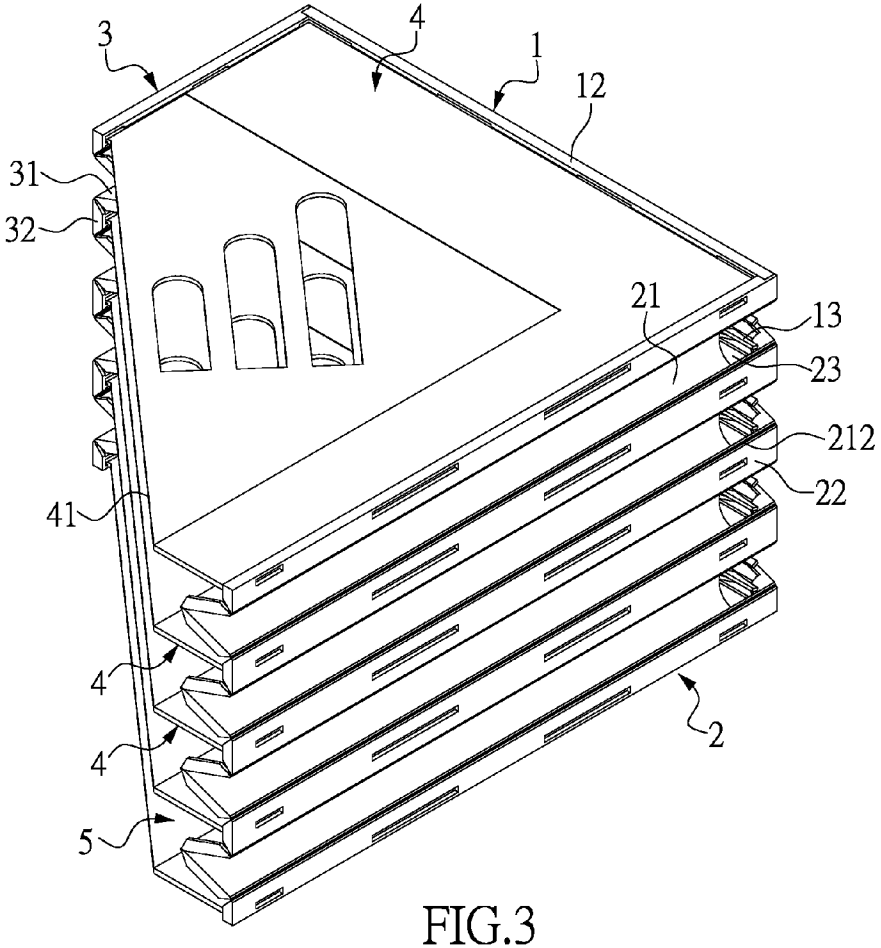
FIG. 3 is an assembled view of the document organizer in accordance with the instant disclosure.
Figure 4:
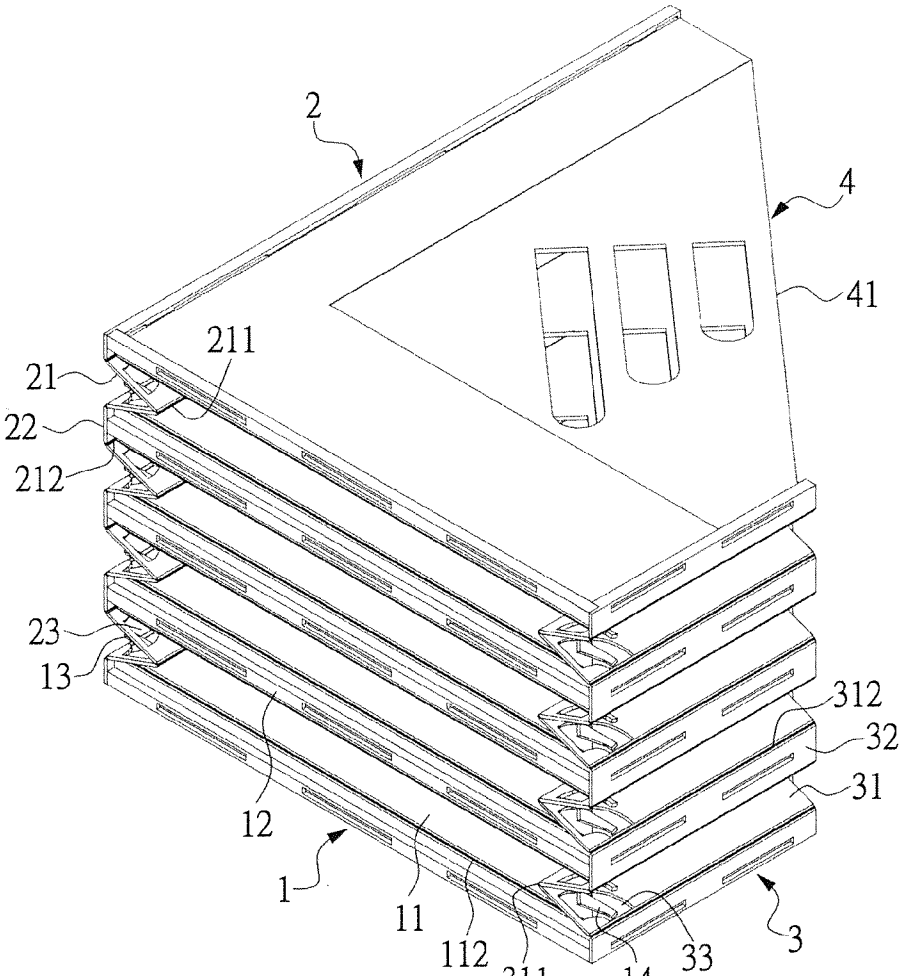
FIG. 4 is another assembled view of the document organizer in accordance with the instant disclosure.
Figure 5:
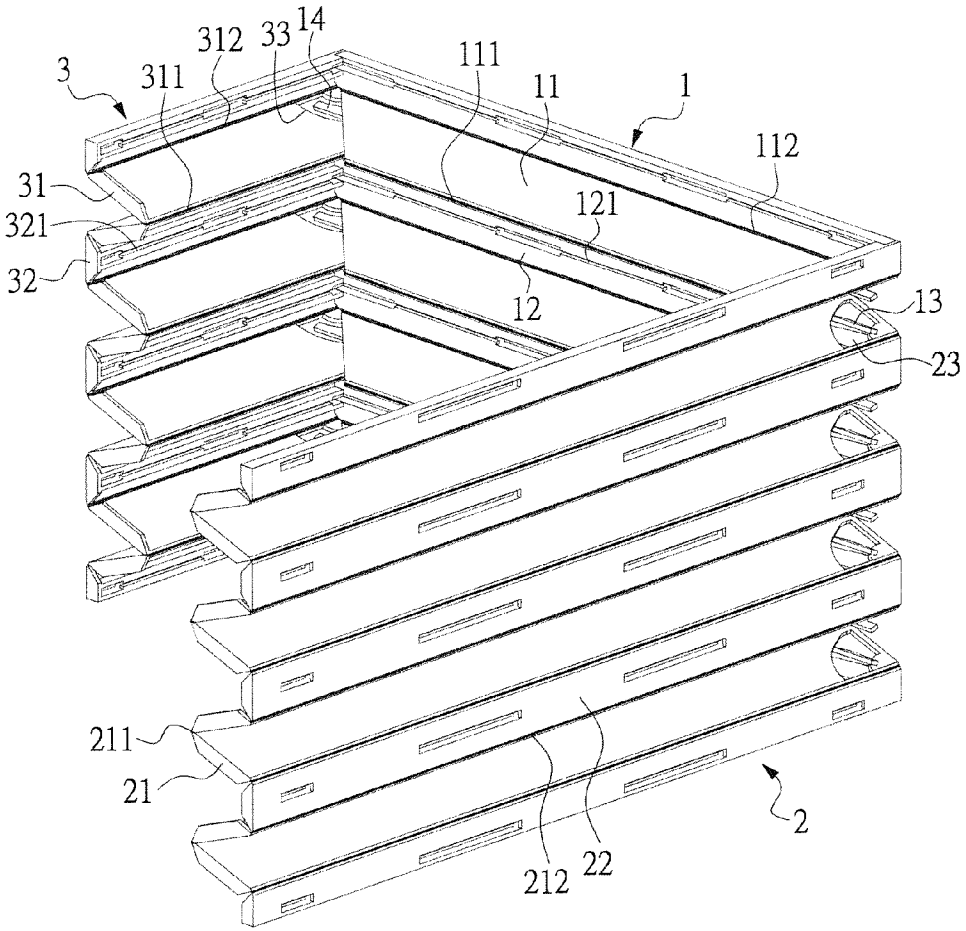
FIG. 5 is a perspective view of the document organizer with dividers removed in accordance with the instant disclosure.

During assembly of the document organizer, the fourth coupling portion 42 of the divider 4 and the first coupling portion 121 of the base frame 1 can be mutually fastened to each other, the fifth coupling portion 43 of the divider 4 and the second coupling portion 221 of the rear frame 2 can be mutually fastened to each other, and the sixth coupling portion 44 of the divider 4 and the third coupling portion 321 of the front frame 3 can be mutually fastened to each other such that the base, rear, and front frames 1, 2, 3 respectively connect to the base, rear, and front ends of the divider 4. As a result of the connection, the base frame 1, rear frame 2, front frame 3, and the dividers 4 cooperatively define a plurality of storage spaces therebetween. At such time, the rear fixing tabs 13 are respectively coupled into the rear fixing openings 23, and the front fixing tabs 14 are respectively coupled in the front fixing openings 33 (as shown in FIGS. 3 and 4). FIGS. 3 and 4 illustrate the assembled document organizer in a semi-contracted state. Namely, the document organizer can continue to contract and flatten in order to save space when the document organizer is not in use. Alternatively, the document organizer can be pulled to expand (not shown in figures) such that the base frame 1, rear frame 2, and the front frame 3 are expanded to resemble flat boards. Meanwhile, relatively larger storage spaces 5 are formed to facilitate documents storage. When the base frame 1, rear frame 2, and the front frame 3 are expanding, the rear fixing tabs 13 and the rear fixing openings 23 are mutually coupled whereas the front fixing tabs 14 and the front fixing openings 33 are mutually coupled as well. Namely, the two rear fixing tabs 13 of each base board 11 and the two rear fixing openings 23 of each rear board 21 are mutually wedged to each other. The two front fixing tabs 14 of each base board 11 and the two front fixing openings 33 of each front board 21 are mutually wedged to each other such that the document organizer is stably fixed in an expanded state.

The base frame, rear frame, and front frame of the document organizer respectively have folding lines arranged thereon (the first folding line to the sixth folding line) such that when the document organizer is assembled, the document organizer can be contracted to save space. A divider can provide two adjacent storage spaces. As illustrated in the instant embodiment, on five dividers are necessary to partition into four storage spaces, which saves in materials.

Figure 6:
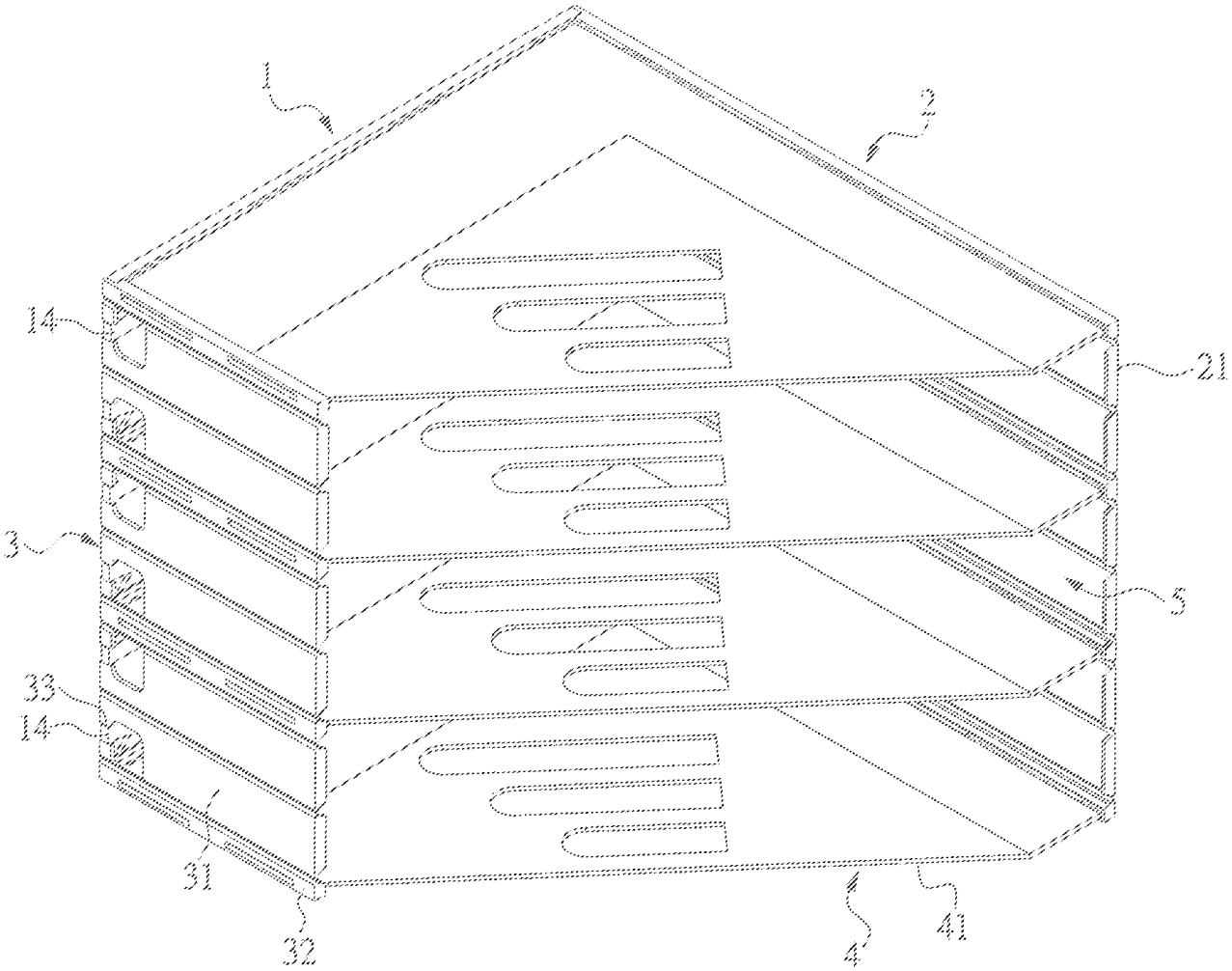
FIG. 6 is another assembled view of the document organizer in accordance with another embodiment of the instant disclosure.
Figure 7:
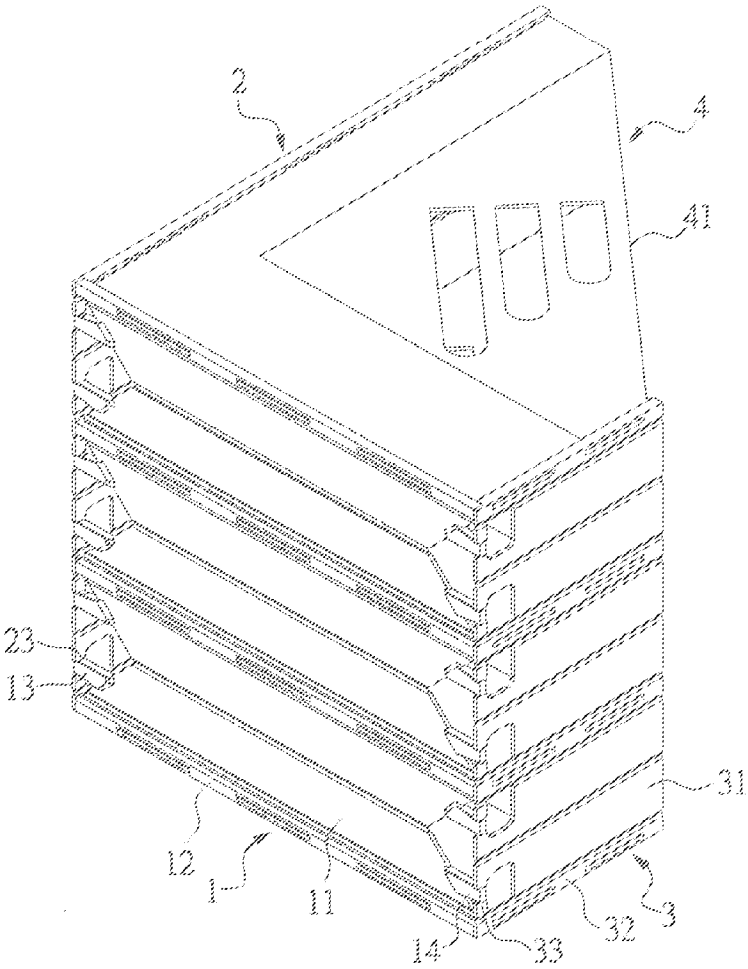
FIG. 7 is another assembled view of the document organizer in accordance with another embodiment of the instant disclosure.

Please further refer to FIGS. 6 and 7. In the instant embodiment, three boards, the base board 11, rear board 21, and front board 31, are configured with four dividers 4 such that the base frame 1, the rear frame 2, the front frame 3, and the dividers 4 cooperatively partition three storage spaces 5 therebetween. In the expanded state, the base frame 1, the rear frame 2, and the front frame 3 expand to resemble flat boards in order to form relatively larger storage spaces, compared to the semi-contracted state, to facilitate documents storage. The shapes of the rear fixing tabs 13, the front fixing tabs 14, the rear fixing openings 23, and the front fixing openings 33 vary. As the base frame 1, the rear frame 2, and the front frame 3 expand, the rear fixing tabs 12 and the rear fixing openings 23 mutually engaged whereas the front fixing tabs 14 and the front fixing openings 33 mutually engaged such that the document organizer is stably fixed in the expanded state.

The figures and descriptions supra set forth illustrated the preferred embodiments of the instant disclosure; however, the characteristics of the instant disclosure are by no means restricted thereto. All changes, alternations, combinations or modifications conveniently considered by those skilled in the art are deemed to be encompassed within the scope of the instant disclosure delineated by the following claims.

What is claimed is:

1. A document organizer, comprising:

a base frame including a plurality of base boards and a plurality of base connecting boards, each base board having a first folding line arranged on a center portion thereof, each base board having two sides, each side connected to the corresponding base connecting board through a second folding line, and each base connecting board having a first coupling portion arranged thereon;

a rear frame including a plurality of rear boards and a plurality of rear connecting boards, each rear board having a third folding line arranged on a center portion thereof, each rear board having two sides, each side connected to the corresponding rear connecting board through a fourth folding line, and each rear connecting board having a second coupling portion arranged thereon;

a front frame including a plurality of front boards and a plurality of front connecting boards, each front board having a fifth folding line arranged on a center portion thereof, each front board having two sides, each side connected to the corresponding front connecting board through a sixth folding line, and each front connecting board having a third coupling portion arranged thereon; and a plurality of dividers, each having a fourth coupling portion arranged on a base portion of each divider, a fifth coupling portion arranged on a rear portion of each divider, and a sixth coupling portion arranged on a front portion of each divider, the base portions of the dividers respectively coupled to the base connecting boards of the base frame, the rear portions of the dividers respectively coupled to the rear connecting boards of the rear frame, the front portions of the dividers respectively coupled to the front connecting boards of the front frame, and the base frame, rear frame, front frame, and the dividers cooperatively define a plurality of storage spaces.

2. The document organizer as recited in claim 1, wherein the first coupling portion is a coupling female portion, and the fourth coupling portion is a coupling male portion corresponding to the first coupling portion.

3. The document organizer as recited in claim 1, wherein the second coupling portion is a coupling female portion, and the fifth coupling portion is a coupling male portion corresponding to the second coupling portion.

4. The document organizer as recited in claim 1, wherein the third coupling portion is a coupling female portion, and the sixth coupling portion is a coupling male portion corresponding to the third coupling portion.

* * * * *